United States Patent [19]

Mears

[11] Patent Number: 4,531,821

[45] Date of Patent: Jul. 30, 1985

[54] ITEM TRANSPORTING

[75] Inventor: Eric Mears, Rockport, Mass.

[73] Assignee: Cordell Engineering, Inc., Peabody, Mass.

[21] Appl. No.: 560,128

[22] Filed: Dec. 12, 1983

[51] Int. Cl.[3] ..... G03D 3/08

[52] U.S. Cl. ..... 354/320; 134/83; 198/342

[58] Field of Search ..... 354/320, 322, 316; 134/82, 83, 158, 159, 79; 198/342

[56] References Cited

U.S. PATENT DOCUMENTS

| | | | |
|---|---|---|---|
| 3,469,517 | 9/1969 | Nishimoto | 354/322 |
| 4,112,452 | 9/1978 | Patton | 354/322 |
| 4,153,363 | 5/1979 | Albano | 354/322 |
| 4,429,980 | 2/1984 | Miller | 354/322 |
| 4,445,769 | 5/1984 | Fisher | 354/322 |

*Primary Examiner*—A. A. Mathews

*Attorney, Agent, or Firm*—Charles Hieken

[57] ABSTRACT

A transport mechanism has two driven gears driven by a driving gear therebetween and having pivotally attached cranks at pivot points maintained at the same elevation as the driven gears rotate. The upper end of the cranks are attached to a horizontal moving guide bar. The moving mechanism is supported beside a fixed guide plate formed with a loading slot at the input end, a sloping edge at the output end and a number of equally spaced vertical slots therebetween. A film carrier has end rods which may rest on the moving guide bars and be lowered in the slots. Film chips in the film carrier advance from the loading slot into a developing tank. The mechanism then lifts the carrier with the film chips above the carrier tank and into a wash tank, then from the wash tank into a fixing tank, then from the fixing tank into a wash tank, then into a drying chamber and then upon an output ramp.

12 Claims, 1 Drawing Figure

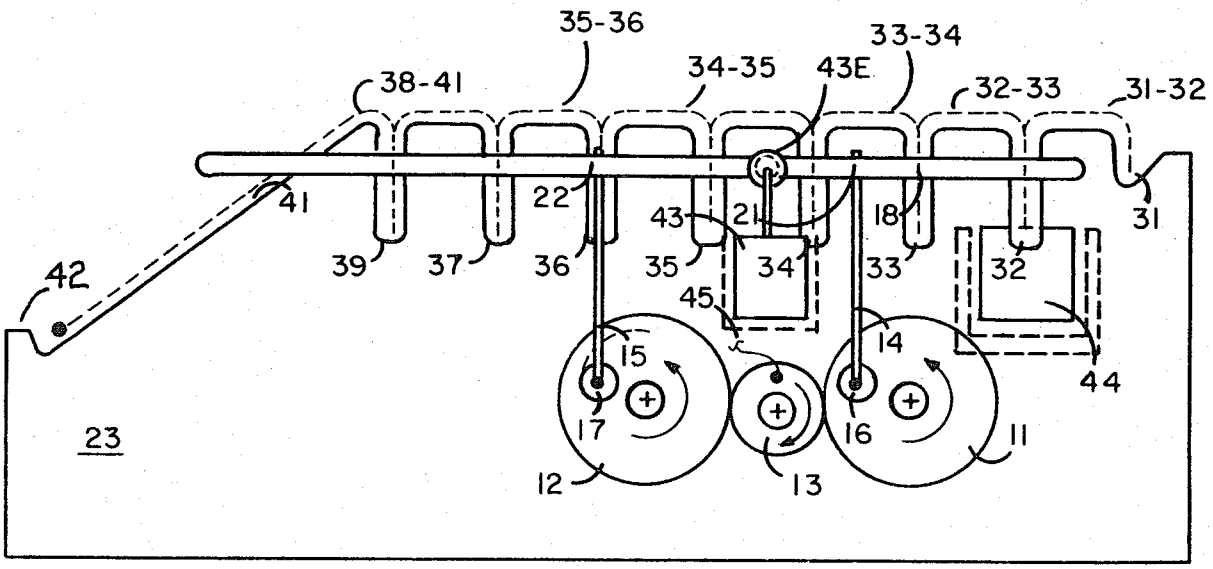
31-32
31
32-33
32
33-34
33
43E
34-35
34
35-36
35
38-41
39
37
36
22
21
18
43
45
44
14
15
16
17
11
12
13
41
42
23

ITEM TRANSPORTING

The present invention relates in general to item transporting and more particularly concerns novel apparatus and techniques for transporting film chips from one location to another in an automatic batch developing system of the type shown in U.S. Pat. No. 4,153,363 entitled BATCH DEVELOPING granted May 8, 1979, to facilitate transport with a mechanism that operates reliably and is relatively inexpensive to fabricate.

The batch system described in the patent identified above includes a film holder that receives film chips for developing and enters through an input opening where a transport mechanism carries the film holder into a developer tray having a thermistor for providing a signal representative of the developer temperature. This signal is used to control the development time to vary inversely as a function of temperature. At the end of the development cycle the transport mechanism lifts the film holder from the developer tank, carries it to the fixing tank and deposits it in the fixing tank. At the end of the next development cycle, the transport mechanism lifts the film holder from the fixing tank, transports it to the wash tank and deposits it in the wash tank. At the end of the next developing cycle, the transport mechanism lifts the film holder from the wash tank and deposits it in the drying chamber where forced hot air dries the developed fixed washed film chips. They may then be removed through an exit door.

The transport mechanism included a pair of transport bars formed with V-shaped grooves for accommodating supporting fittings of the film carrier. The means for supporting the transport arms comprised a first endless belt near the entrance end and a second endless belt near the exit end, each endless belt comprising a sprocket chain forming essentially a rectangular loop with a sprocket wheel or gear pivotally supported in each corner from a side panel. A drive gear attached to first and second drive shafts near the entrance and exit ends and driven by a drive belt drove all four endless belts in synchronism to effect the transporting operation.

It is an important object of this invention to provide an improved transport mechanism.

According to the invention, the improved transport mechanism comprises first and second driven gears near entrance and exit ends, respectively, of a system in which the transported items move, system driven in synchronism by means, such as a driving gear between them that may be connected to the shaft of a motor or other suitable power source. First and second cranks are pivotally connected to corresponding points near the perimeters of the first and second gears at one end and to points near respective ends of a moving guide bar that carries the item carrier from one location to the next. Means, such as a magnet mounted on a gear and a magnetic reed switch identify a reference point of the gear assembly to control energization and deenergization of the motor providing power to the driving gear in accordance with a control circuit.

Numerous other features, objects and advantages of the invention will become apparent from the following specification when read in connection with the accompanying drawing, The single FIGURE of which is a diagrammatic representation of an embodiment of the invention.

With reference now to the drawing, there is shown a diagrammatic representation of an embodiment of the invention. Since the aforesaid patent described in detail a batch developing system having left and right mechanisms that operate in synchronism to effect transporting, the improvement may be better described with the diagrammatic representation in the drawing showing only a diagrammatic representation of one side panel and the mechanism on one side, it being understood that the identical mechanism operating in synchronism is preferably on the other side also operating in synchronism.

The transport mechanism comprises front and rear driven gears 11 and 12, respectively, that mesh with driving gear 13 therebetween. Front and rear cranks 14 and 15, respectively, are pivotally connected near the perimeter of driven gears 11 and 12, respectively, at pivot points 16 and 17, respectively, that remain at the same elevation. The upper ends of cranks 14 and 15 are rigidly connected to moving guide bar 18 at input and output pivot points 21 and 22, respectively. Side 23 functions as a fixed guide or cam plate by being formed with an input recess 31, seven notches 32–38 and a downwardly sloping edge 41 at the rear contiguous with rear support tab 42. Side 23 also isolates the tanks on the other side from the gears and linkages comprising the transport mechanism. Film carrier 43 rides on moving guide bar 18 and is shown slightly displaced between slots 34 and 35 so as not to obscure the paths represented by the broken lines leading from slot to slot. A developing tank 44 is shown at the input end; however, the other tanks are omitted to avoid obscuring the principles of operation of the novel transport mechanism. A magnet 45 on driving gear 13 may be sensed by means, such as a magnetic reed switch (not shown) to deenergize the driving motor when the carrier is seated in the bottom of a slot.

Having set forth the physical arrangement of the novel transport mechanism, its mode of operation will be described. Film carrier 43 with exposed X-ray film chips is placed in loading slot 31, and the drive motor (not shown) energized to start a developing cycle by moving driving gear 13 clockwise to move driven gears 11 and 12 counterclockwise to carry moving guide bar 18 downward and to the right toward the input end, then upward and toward the right toward the input end until it engages film carrier 43 seated in slot 31, then upward and to the left toward the rear with carrier 43 supported thereon over path 31-32 until end support rods 43E of carrier 43 enter slot 32. Moving guide rod 18 continues moving downward and toward the right, but carrier 43 is restricted to moving only downward in slot 32 while free to slide along moving guide bar 18. When support fitting 43E of carrier 43 is seated at the bottom of slot 32, the reed switch or other suitable sensor detects magnet 45 and turns the drive motor off until the developing cycle is completed in the manner described in the aforesaid patent.

Upon completion of the cycle, the drive motor is again energized to repeat the cycle just described, but this time, moving guide bar 18 transports film carrier 3 over path 32-33 into slot 33 where it may be lowered into a wash tank, for example, not shown. The next cycle results in transporting carrier 43 over path 33-34 until it is seated in slot 34, typically the fixing bath tank, for example. On the next cycle moving guide bar 18 transports carrier 43 over path 34-35 to slot 35, which may be a wash tank, for example. On the next cycle, moving guide bar 18 transports film carrier 43 over path 35-36 into slot 36, which may be the drying compartment. On the next two cycles moving guide bar 18 transports film carrier 43 over paths 36-37 and 37-38 into slots 37 and 38, respectively, which may also be in the drying compartment, for example. On the last cycle, moving guide bar 18 transports carrier 43 over path 38-41 to sloping edge 41 where it slides downward to engage tab 42 and may then be removed from the system dry and developed. The path traveled by carrier 43 from input notch 31 to notch 38 includes a generally cycloidal component.

The invention has a number of advantages and features. It moves carrier 43 in a complex rectilinear path with only one actuator, the motor, and the simple circular path of the moving drive bars. The guide or cam plate 23 performs the additional function of a shield between the tanks and the drive mechanism. Transport is accomplished by simply logic pulsing the drive motor revolution by revolution. The mechanism may transport a multiplicity of carriers from slot to slot at any time. The film chips remain in the carrier during processing to facilitate identification.

It is preferred that the slots be equally spaced a distance corresponding substantially to the diameter of the circle of revolution traveled by pivot points 16 and 17. It is also preferred that the depth of slots 32–38 is preferably less than this diameter so that the carrier may be lifted above the top of the slot and rest in the bottom. Preferably, the length of moving guide rod 18 is slightly longer than the distance between loading slot 31 and sloping edge 41. Preferably driven gears 11 and 12 are of the same diameter and the gear assembly is centered in the system.

It is evident that those skilled in the art may now make numerous uses and modifications of and departures from the specific apparatus and techniques described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Transporting apparatus comprising, first and second driven rotating members, first and second crank means pivotally connected to said first and second driven rotating members, respectively, at pivot points near the periphery of each for converting rotary motion into rectilinear motion, moving guide bar means connected to said first and second crank means respectively for imparting both vertical and horizontal motion, and stationary guide means for engaging carrier means for supporting an item to be transported and coacting with said moving guide bar means for restricting translation of said carrier means when supported by said guide bar means, said carrier means being slidably supportable on said moving guide bar means and slidable in said stationary guide means for supporting items to be transported along a path having a cycloidal component.

2. Transporting apparatus in accordance with claim 1 and further comprising, driving means for driving said first and second driven rotating members in synchronism with said pivot points maintained at substantially the same height as said first and second driven members rotate in synchronism.

3. Transporting apparatus in accordance with claim 1 wherein said driving means comprises a driving member engaging and sandwiched between said first and second driven members so that rotary motion in one sense of said driving member causes rotary motion in the opposite sense of said first and second driven rotating members.

4. Transporting apparatus in accordance with claim 1 and further comprising motion restricting means in said stationary guide means for restricting horizontal movement of said carrier means.

5. Transporting apparatus in accordance with claim 4 wherein said motion restricting means comprises means defining generally vertical slots in said stationary guide means.

6. Transporting apparatus in accordance with claim 5 wherein the spacing between adjacent vertical slots is substantially equal to the diameter of the circle of revolution traveled by said pivot points where said first and second crank means are pivotally connected to said first and second driven rotating members respectively, the depth of said slots being less than said diameter so that said carrier means may be lifted above the top of a slot and rest in the bottom of a slot.

7. Transporting apparatus in accordance with claim 6 wherein the length of said guide bar means is greater than the distance between the first of said slots and the last of said slots and said driven rotating members have substantially the same diameter.

8. Transporting apparatus in accordance with claim 7 wherein the assembly comprising said first and second driven rotating members and said driving member is centered along the length of said stationary guide means.

9. Transporting apparatus in accordance with claim 6 wherein said stationary guide means is formed with a downwardly sloping edge terminating in a tab for allowing said carrier means to slide downward on said edge and rest against said tab.

10. A method of using transporting apparatus comprising first and second driven rotating members, first and second crank means pivotally connected to said first and second driven rotating members respectively at pivot points near the periphery of each for converting rotary motion into rectilinear motion, moving guide bar means connected to said first and second crank means respectively for imparting both vertical and horizontal motion and stationary guide means for engaging carrier means for supporting an item to be transported and coacting with said moving guide bar means for restricting translation of said carrier means when supported by said guide bar means, said carrier means being slidably supportable on said moving guide bar means and slidable in said stationary guide means for supporting items to be transported along a path having a cycloidal component, which method includes the steps of, rotating said first and second driven rotating members in synchronism to cause said guide bar means to engage said carrier means, lift it above said stationary guide means and lower it toward said stationary guide means at a location spaced from the location where said lifting occurred.

11. A method in accordance with claim 10 and further including repeating the steps of claim 10 to advance said carrier means from one end of said moving guide bar means to the other.

12. A method in accordance with claim 11 wherein said transporting apparatus includes tank means for supporting a substance for processing items carried by said carrier means and further including, lifting with said carrier means said items from an input location spaced along said path from said tank means, depositing said items while supported in said carrier means into said tank means, and lifting said items from said tank means with said carrier means.

* * * * *